US009326598B1

(12) United States Patent
West et al.

(10) Patent No.: US 9,326,598 B1
(45) Date of Patent: May 3, 2016

(54) RISE UP TABLE TOP

(71) Applicants: Virgil J. West, Sarasota, FL (US); Daniel Miller, Sarasota, FL (US)

(72) Inventors: Virgil J. West, Sarasota, FL (US); Daniel Miller, Sarasota, FL (US)

( * ) Notice: Subject to any disclaimer, the term of this patent is extended or adjusted under 35 U.S.C. 154(b) by 0 days.

(21) Appl. No.: 14/730,229

(22) Filed: Jun. 3, 2015

Related U.S. Application Data

(60) Provisional application No. 62/007,383, filed on Jun. 3, 2014.

(51) Int. Cl.

| | |
|---|---|
| ***A47B 3/02*** | (2006.01) |
| ***A47B 21/02*** | (2006.01) |
| ***A47B 9/02*** | (2006.01) |
| ***A47B 9/16*** | (2006.01) |
| ***A47B 23/04*** | (2006.01) |

(52) U.S. Cl.
CPC . *A47B 21/02* (2013.01); *A47B 3/02* (2013.01); *A47B 9/02* (2013.01); *A47B 9/16* (2013.01); *A47B 23/04* (2013.01); *A47B 2003/025* (2013.01)

(58) Field of Classification Search
CPC ..... A47B 3/02; A47B 3/0809; A47B 3/0815; A47B 2003/025; A47B 83/02; A47B 19/08; A47B 23/001
USPC ..... 108/116–118, 120, 43, 145; 248/164, 248/431, 432, 439; 312/306, 312
See application file for complete search history.

(56) References Cited

U.S. PATENT DOCUMENTS

| | | | | | |
|---|---|---|---|---|---|
| 1,234,569 | A * | 7/1917 | Rehfuss | A47B 3/00 | 108/118 |
| 1,318,564 | A * | 10/1919 | Jenkins | A47B 9/00 | 108/145 |
| 2,156,148 | A * | 4/1939 | Di Giacomo | A47D 1/02 | 248/421 |
| 2,630,359 | A | 3/1953 | Shade | | |
| 4,926,760 | A | 5/1990 | Sack | | |
| 5,497,706 | A * | 3/1996 | Yong | A47B 3/0815 | 108/129 |
| 5,588,377 | A | 12/1996 | Fahmian | | |
| 5,833,200 | A | 11/1998 | Patterson | | |
| 6,182,935 | B1 * | 2/2001 | Talesky | B23D 47/025 | 108/118 |
| 6,701,853 | B1 | 3/2004 | Hwang | | |
| 7,849,789 | B1 * | 12/2010 | Whelan | A22C 17/0013 | 108/116 |
| 8,015,638 | B2 * | 9/2011 | Shimada | A47C 19/04 | 108/145 |
| 8,544,391 | B2 * | 10/2013 | Knox | B60N 3/063 | 108/12 |
| 8,936,306 | B2 * | 1/2015 | Liu | A47C 11/00 | 297/144 |

* cited by examiner

*Primary Examiner* — Janet M Wilkens
(74) *Attorney, Agent, or Firm* — Dorothy S. Morse

(57) ABSTRACT

A lightweight and portable table that during its use can be set upon a desk or another table, and which has an upwardly extendable top surface with a maximum elevation of approximately one foot. It allows people working in a seated position at their desk to adjust the working top surface thereof to a more comfortable position, and alternatively allow them to comfortably work from the elevated top surface while in a standing position. The portable table is easy to manage, movable from one support surface to another with little effort, spring-assisted with load during up and down deployment, and it promotes improved health and welfare of its users. Applications include, but are not limited to, home use, business use, and use by healthcare workers who need prompt access to instruments and devices while in both sitting and standing positions when caring for different patients during a work day.

18 Claims, 8 Drawing Sheets

RISE UP TABLE TOP

CROSS-REFERENCES TO RELATED APPLICATIONS

The applicants herein request domestic priority based upon their U.S. provisional patent application 62/007,383 that was filed last year on 3 Jun. 2014 for substantially the same subject matter. The title of U.S. provisional patent application 62/007,383 was the same, Rise Up Table Top.

BACKGROUND

1. Field of the Invention

This invention relates to desks and tables having an adjustable top surface, particularly to a lightweight and portable table that can be set upon the surface of a desk or another table, and which also allows its top surface to be extended to a maximum height of approximately one foot. It allows a person working in a seated position at their desk or a table to adjust the working top surface thereof to a more comfortable position (reducing eye, neck, or back strain), or alternatively allows that person to comfortably work from the present invention's elevated top surface while standing. It is designed to be easy to manage, readily portable from one work surface (desk, table, credenza, countertop, or other) to another with little effort, spring-assisted with load during up and down deployment, and it promotes improved health and welfare of its user, or users. Applications include but are not limited to home use, business use, use by people who would otherwise sit for extended periods of time performing a task, and use by healthcare workers who need prompt access to instruments and devices when in both sitting and standing positions while caring for different patients during a work day.

2. Description of the Related Art

In many offices, workers sit at a desk during most of their day while using a computer. The daily sitting for long periods of time is cumulatively detrimental to their health, particularly when other commitments in their lives prevent them from obtaining regular exercise outside of the workplace. The present invention helps such workers in two ways. First, it may raise a worker's computer screen to a more suitable elevation for better worker posture, less screen glare, and improved productivity. Second, it provides an opportunity for the worker to alternatively sit and stand during a day to conduct needed work, enhancing the worker's metabolism, leg muscle activity, alertness, and overall health.

The invention thought to be most similar the present invention in purpose is the product found on the Internet website of www.varidesk.com. Although the VARIDESK™ also allows a worker to sit or stand while using a computer, there are important structural differences between the present invention and the VARIDESK™ invention. One readily visible difference is the collapsing structure used in each invention. The VARIDESK™ invention has a collapsed height of 5-inches, and a footprint of 30-inches (width) by 27-inches (depth), and for elevation of its top surface uses a pair of parallel support bars on each side that form a Z-shaped connection with the top and bottom structure of the VARIDESK™ invention. One horizontally-extending support plate is also connected between the opposed rear support bars, and the VARIDESK™ invention provides a keyboard support. In contrast, the present invention has an X-shaped elevation structure with seven rods (three medium axis rods, two large axis rods, and two lock rods) extending between opposing sides of the invention. Also, the most preferred embodiment of the present invention is smaller than the VARIDESK™ invention, and has a collapsed height of less than 4-inches, and a footprint of approximately 28-inches (width) by 20-inches (depth). Furthermore, instead of a keyboard support, the present invention has opposed locking/release handles, and its table top has an indentation or groove in a position near and substantially along its front surface and an opposing carrying handle cutout near its rear edge that can be used for insertion of fingers on one hand to assist in moving or carrying the present invention from one position or location to another.

The inventors of the present invention have also found several adjustable table inventions, even a few that use an X-shaped support between it top surface and base/support. However, the present invention structure is distinguishable, and its differences provide new and different benefits and advantages to its users. One known adjustable table invention is a lap desk disclosed in U.S. Pat. No. 5,833,200 to Patterson (Nov. 10, 1998), the top surface of which has elevation and angled movement from a compact/collapsed position. However, the Patterson lap desk has opposed side supports that are substantially planar and do not have an X-shaped configuration. In contrast, the side supports of the vertically shiftable platform in U.S. Pat. No. 2,630,359 to Schade (Mar. 3, 1953) has a pair of parallel bars on each side that have a substantially Z-shaped connection to the bottom of the platform and the support surface below them. The adjustable table inventions in U.S. Pat. No. 4,926,760 to Sack (May 22, 1990), U.S. Pat. No. 5,588,377 to Fahmian (Dec. 31, 1996), and U.S. Pat. No. 6,701,853 B1 to Hwang (Mar. 9, 2004) all have supports with an X-shaped configuration, however each is different in the connection of the X-shaped support to the top work surface. Furthermore, the Sack and Fahmian inventions each have more complexity in their X-shaped support and elevation structures which would make them heavier and less easily portable than the present invention. Also, the Sack and Fahmian inventions each have more complexity in the base to which the X-shaped support and elevation structures are connected than does the present invention, with the present invention simply having two opposed L-shaped base rails. While the Hwang invention is more visibly similar to the present invention, the top surfaces of its opposed X-shaped support and elevation structures connect to the central portion of the bottom surface of its top surface, similar to the Sack and Fahmian inventions, but opposed to the positioning of the top ends of the present invention X-shaped support and elevation structures, which are adjacent to the side edges of its table top. Furthermore, the bottom surfaces of the opposed X-shaped support and elevation structures in the Hwang invention move within a rectangular frame, similar to the Sack and Fahmian inventions, but opposed to the substantially parallel and L-shaped base rails used in the present invention. The Hwang invention is also different from the present invention as it has no center axis rod, no side locking/release handles, and no groove or carrying handle cutout in the upper surface of its table top. There is no invention known with the same structure as the present invention, or one providing all of its benefits and advantages.

BRIEF SUMMARY OF THE INVENTION

It is the primary object of this invention to provide a portable table that can be set upon the surface of a desk or another table, and which also allows prompt and easy vertical movement of its top surface so that a person may use it while seated or alternatively while standing. It is also an object of this invention to provide portable table that is lightweight and has a compact collapsed configuration for fast and easy movement to a new location. It is a further object of this invention to provide a portable table that is usable at home and in office settings. Another object of this invention to provide a table with a top surface that can be extended to a maximum height of at least one foot. It is a further object of this invention is to provide a portable table made of sturdy and durable materials for repeat use. It is also a further object of this invention to provide a portable table that is easy to install and use. It is also an object of this invention to provide a portable table that locks in at least one position between its fully extended and fully collapsed configurations. It is a further object of this invention to provide a portable table that requires no user assembly prior to its use. It is also an object of this invention to provide a portable table that is simple in design for cost efficient manufacture.

When properly made and used, the present invention provides a lightweight and portable table that can be set upon the surface of a desk or another table, and which also allows its top surface to be extended to a maximum height of approximately one foot to allow a person to work in a seated position or alternatively allow that person to comfortably work from the present invention's elevated top surface while standing. It is designed to be easy to manage, readily portable from one work surface to another with little effort, spring-assisted with load during up and down deployment, and it promotes improved health and welfare of its user. Applications include but are not limited to home use, business use, use by people who would otherwise sit for extended periods of time performing a task, and use by healthcare workers who need prompt access to instruments and devices when in both sitting and standing positions while caring for different patients during a work day. It is simple in design for cost efficient manufacture, having a simple L-shaped base rail instead of a rectangular frame for movement of its opposed X-shaped support and elevation structures. It is easy to install and use on an existing desk or table by simply placing a high-friction pad under its base rails to prevent them from sliding across the surface of the existing desk or table during use. Also, to change the elevation of the top surface of the present invention, one simply has to pull the two locking/release handles in an upward direction to disengage the locking mechanism, and return the locking/release handles to their previous position when locking the top surface of the present invention at a new elevation is needed. Furthermore, each lock bar has several notches to allow positioning of the top surface of the present invention at elevations between its fully extended and fully collapsed configurations.

COMPONENT LIST

1—most preferred embodiment of the present invention
2—table top surface
3—groove
3'—reverse side of groove 3
4—carrying handle cutout
5—locking/release handle
6—base rail
7—lifter
8—axis rod
9—locking bar
10—top rail
11—spacer
12—elevation-adjusting slot
13—flat spring
14—extension spring
15—lock rod
16—opening in top rail 10 used for securing locking/release handle 5
17—notch used to accommodate

DETAILED DESCRIPTION OF PREFERRED EMBODIMENTS

The present invention is a lightweight and portable table that can be set upon the surface of a desk, another table, countertop, or the like, and which also allows its top surface to be extended to a maximum height of approximately one foot. It allows a person working in a seated position at their desk to adjust the working top surface thereof to a more comfortable position (reducing eye, neck, or back strain), or alternatively allows that person to comfortably work with equipment and materials on the present invention's elevated top surface while standing. It is designed to be easy to manage, readily portable from one work surface (desk, table, credenza, countertop, or other) to another with little effort, spring-assisted with load during up and down deployment, and it promotes improved health and welfare of its user, or users. Applications include but are not limited to home use, business use, use by people who would other sit for extended periods of time performing a task, and use by healthcare workers who need prompt access to instruments and devices when in both sitting and standing positions while caring for different patients during a work day. FIGS. 1-13 show the different components of the most preferred embodiment of the present invention and preferred positioning of such component in extended and collapsed configurations.

Figure 1:
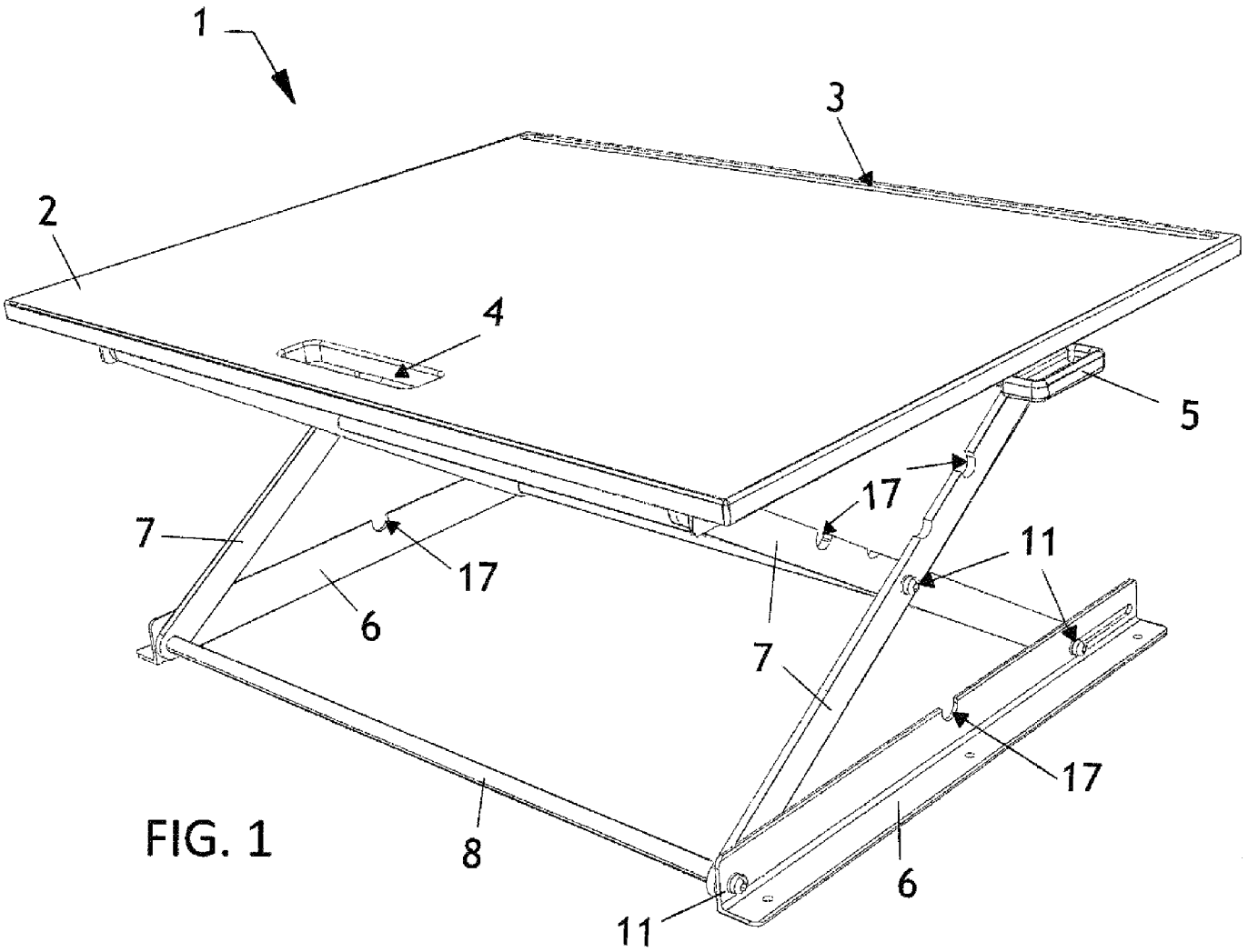
FIG. 1 is a perspective view from the top of the table in the most preferred embodiment of the present invention in an extended configuration and showing its top surface supported by four lifters and two base rails, each pair of lifters joined rotatably at their center portions and forming an X-shaped configuration.
Figure 2:
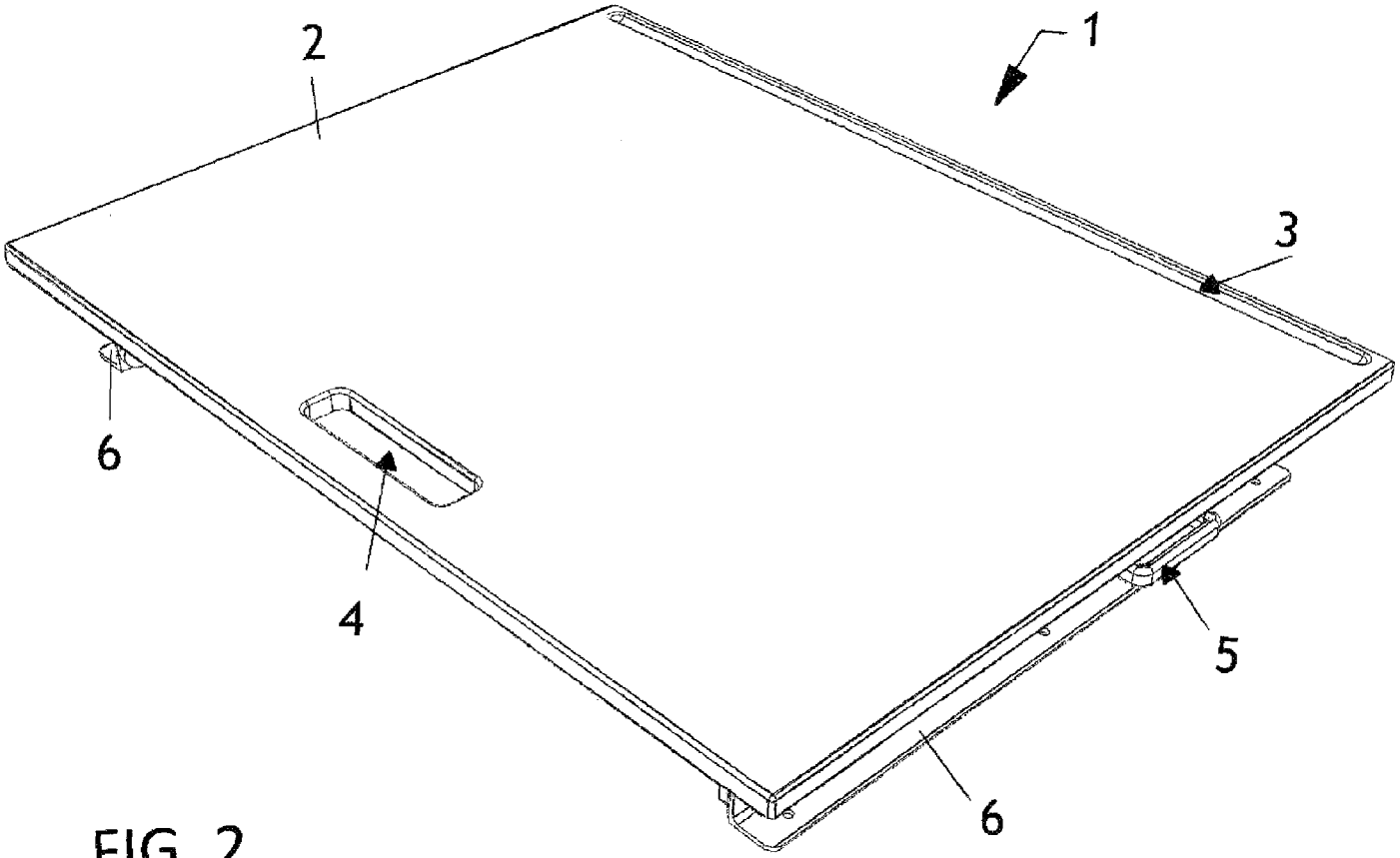
FIG. 2 is a perspective view from the top of the table in the most preferred embodiment of the present invention in a collapsed configuration, showing the two base rails and one locking/release handle.
Figure 3:
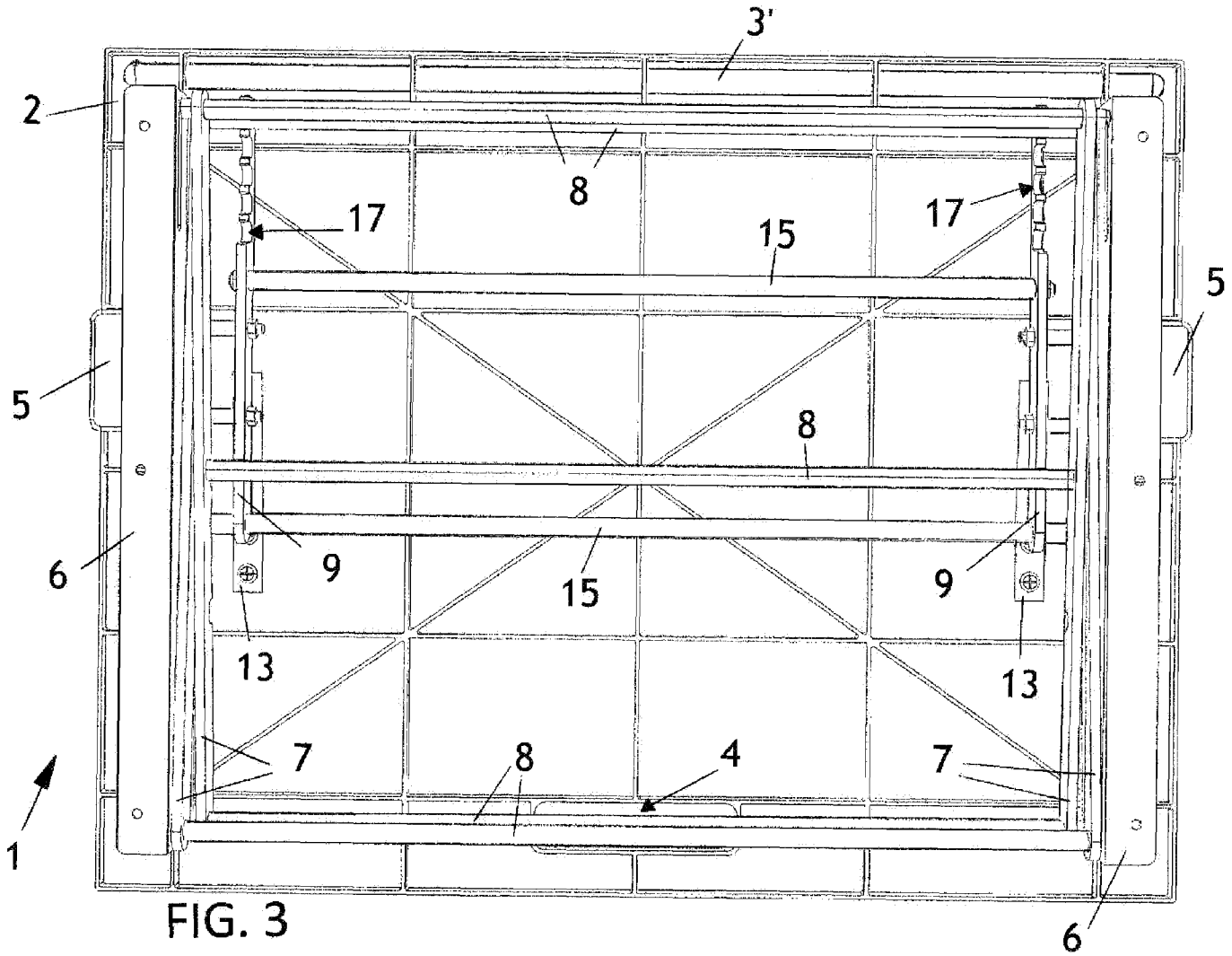
FIG. 3 is a bottom view of the table in the most preferred embodiment of the present invention in a collapsed configuration, showing the opposed base rails, locking rods, locking/release handles, locking bars, and three of the five axis rods.
Figure 4:
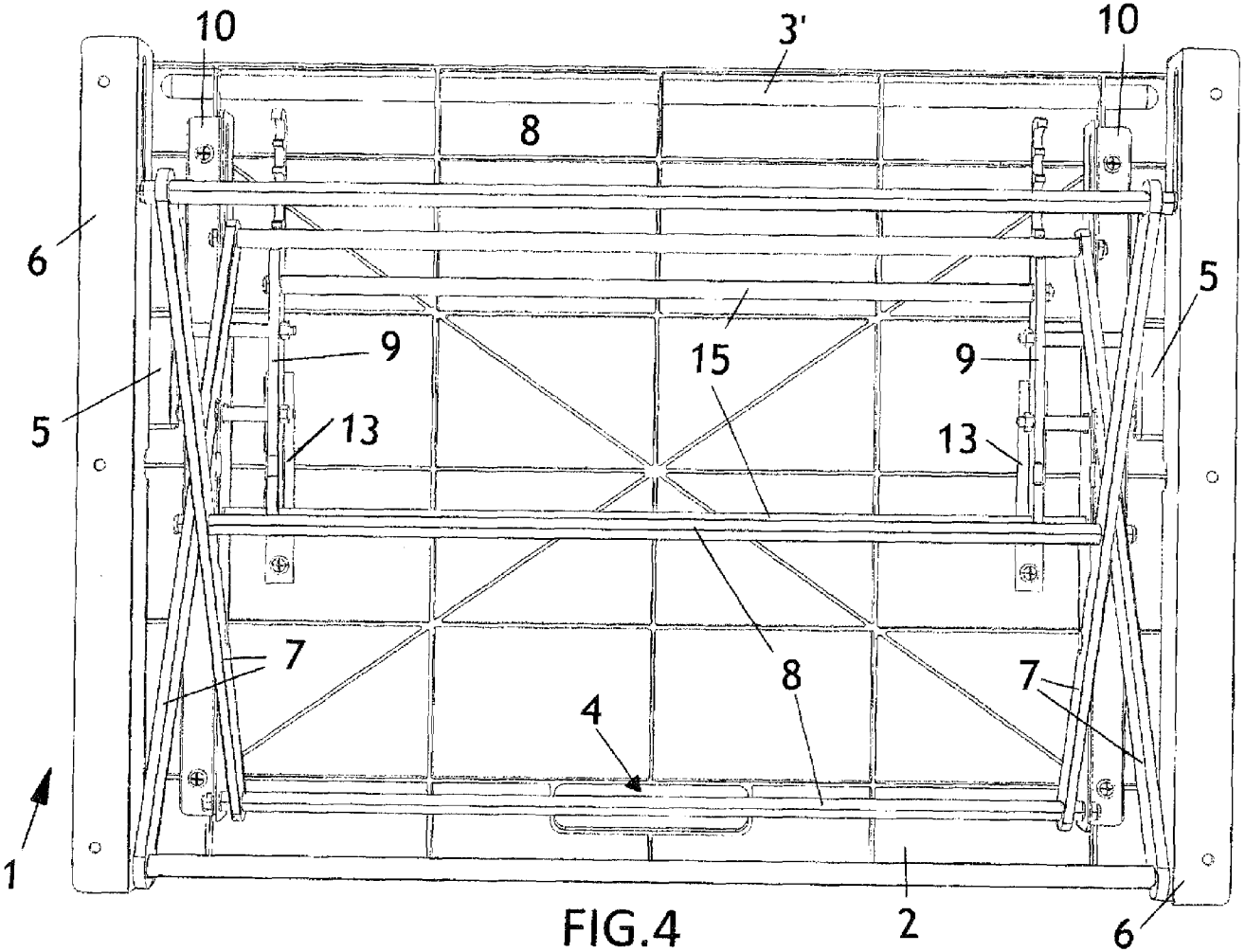
FIG. 4 is a bottom view of the table in the most preferred embodiment of the present invention in an extended configuration.
Figure 5:
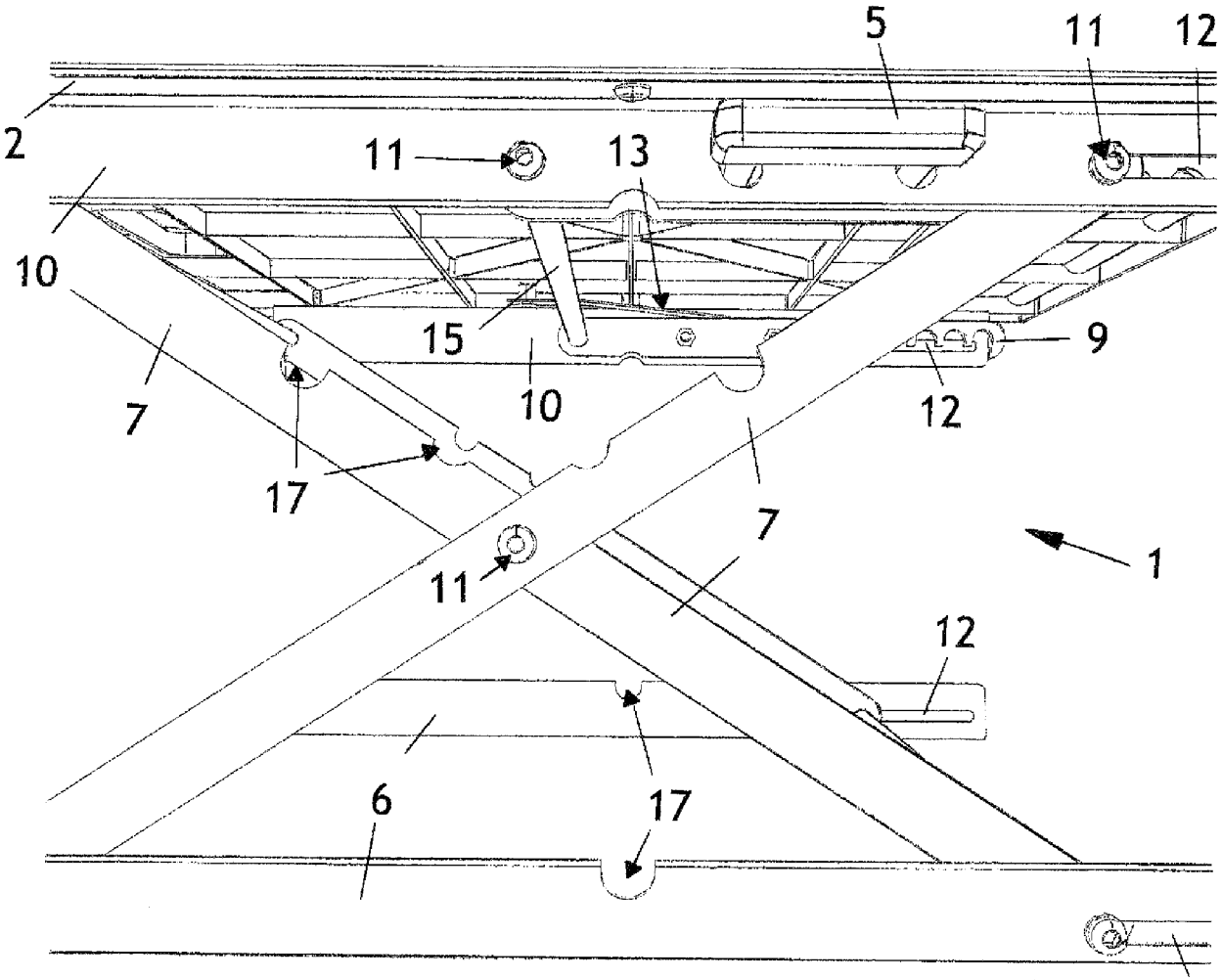
FIG. 5 is a side view of the table in the most preferred embodiment of the present invention in an extended configuration, showing the flat spring used to assist in securing the locking bar.

FIGS. 1-5 show the assembled table 1 of the most preferred embodiment of the present invention. FIG. 1 is a perspective view from the top showing table assembly 1 in an upwardly extended configuration, while FIG. 2 is a perspective view from the top of table assembly 1 in a collapsed configuration. Additionally, FIGS. 3 and 4 are bottom views of table assembly 1 respectively in a collapsed configuration and an extended configuration, while FIG. 5 is a side view of table assembly 1 in an extended configuration, showing the flat spring 13 used to assist in securing the locking bar 9. FIG. 1 shows two spaced-apart base rails 6 below the side edges of the table top surface 2, and also shows table top surface 2 in an elevated position above base rails 6. A front axis rod 8 and a rear axis rod 8 connect the ends of the substantially parallel base rails 6 to one another. Also connected to the opposing ends of the front and rear axis rods 8 are the bottom ends of the four lifters 7, with a bottom end of different lifters 7 connected to each of the two axis rods 8. In addition, FIG. 1 shows two lifters 7 on the same side of table top surface 2 joined rotatably at their center portions and forming an X-shaped configuration, and further shows the top ends of the same lifters 7 extending upwardly toward table top surface 2 for connection to table top surface 2 via a top rail 10 (see example thereof in FIG. 10). FIG. 1 also shows one of the two locking/release handles 5 positioned adjacent to and under one side of table top surface 2. As can be seen in other illustrations (FIGS. 3 and 4), the most preferred embodiment of table assembly 1 has two locking/release handles 5 in opposed positions on opposite sides of the table top surface 2. FIG. 1 further shows table top surface 2 having a groove 3 and a carrying handle cutout 4 in opposed positions respectively near its front and back edges. Groove 3 is shown extending substantially across the width of table top surface 2, but is not limited thereto, and can be used for easily accessible temporary storage of small items, such as pens, highlighters, paperclips, and the like. Carrying handle cutout 4 should have sufficient dimension for the comfortable insertion of four fingers on one adult human hand to assist in the transport of collapsed table assembly 1 to a new location. The width, shape, and depth of groove 3 are not critical, as long as they allow groove 3 to fulfill its needed function. Also, the size and configuration of carrying handle cutout 4 may be different from that shown in FIG. 1. Since it is contemplated for table assembly 1 to be lightweight and easily portable, two carrying handle cutouts 4 for two-handed portability would not generally be needed, although possible. When one carrying handle cutout 4 is present, it is preferred for it to be substantially centered between the sides of table top surface 2. Furthermore, the width, thickness, and/or diameter dimensions of base rails 6, axis rods 8, lifters 7, and locking/release handles 5 may be different from that shown in FIG. 1, as long as the design considerations of 'lightweight' and 'portability' are preserved. In addition, different table top surfaces 2 may have differing dimensions and configurations dictated by the intended application, whether home use, office use, providing a vertically extendable platform for medical equipment, or other application. Although not limited thereto, preferred materials used for manufacture of table assembly 1 are aluminum and recycled plastic. In its most preferred size and configuration, table assembly 1 is lighter in weight than other products having a similar function, has easier portability, can be made from recycled materials, has a lower manufacturing cost, and has a lower adjustable height than the competition, from a collapsed configuration of approximately three-and-one-fourth inches to an expanded configuration of approximately twelve inches.

FIG. 2 is a perspective view from the top which shows table assembly 1 in its collapsed configuration, wherein only table top surface 2 with its groove 3 and opposed carrying handle cutout 4, spaced-apart base rails 6, and one locking/release handle 5 are visible. Although not critical, but desired for enhanced portability, the collapsed height dimension of table assembly 1 can be lower than four-inches. In contrast, FIGS. 3 and 4 are bottom views of table assembly 1. FIG. 3 shows table 1 in a collapsed configuration with the locking features visible, including opposed locking/release handles 5, opposed locking bars 9, and spaced-apart lock rods 15 that extend in substantially parallel orientation to one another between opposed locking bars 6. Also shown in FIG. 3 on the bottom surface of table top surface 2 is the reverse side 3' of groove 3 and carrying handle cutout 4, with FIG. 3 also showing opposed base rails 6 and three of the five axis rods 8, with one axis rod 8 centrally located and extending through the moveable center connection of each pair of lifters 7, and the other two axis rods 8 (one positioned near groove 3 and the other positioned near carrying handle cutout 4) each extending through the bottom ends of two different lifters 7 (one on each side of table 1). The axis rods 8 also extend through both base rails 6. Although the relative dimensions for the components shown in FIG. 3 are most preferred, they are not critical, as assembly explained in the above description of FIG. 1. In comparing FIGS. 3 and 4, FIG. 4 shows table 1 in an extended configuration allowing lifters 7 to be more visible and have numerical marking. Furthermore, opposed top rails 10 are visible in FIG. 4 positioned between base rails 6 and locking bars 9, while the two additional axis rods 8 that were substantially hidden in FIG. 3 are now visible in FIG. 4 and marked with appropriate numerical marking. Opposed locking/release handles 5, the reverse side 3' of groove 3, and carrying handle cutout 4 are also visible in FIG. 4. Another noticeable difference between FIGS. 3 and 4 is that in the collapsed configuration shown in FIG. 3 the axis rods 4 engaging the slots 12 in top rails 10 and base rails 6 are positioned in the ends of elongated slots 12 closest to groove 3 (and remote from handles 5), while in the expanded configuration shown in FIG. 4 the axis rods 4 engaging the slots 12 in top rails 10 and base rails 6 are positioned in the ends of elongated slots 12 closest to handles 5 (and remote from groove 3), as also shown in FIG. 5. FIG. 5 shows the preferred positioning of the flat spring 13 used to assist in securing the locking bar 9 into its various usable positions. Also, the slots 12 in base rail 6 and top rail 10 are shown in FIG. 5, as are the spacers 11 on the ends of the axis rods 8. Slots 12 are also shown in FIGS. 1, 3, and 4, however, due to their small size they were not given numerical identification therein. One lock rod 15 is also shown in FIG. 5, with the other lock rod 15 remaining hidden behind the upper end of one of the lifters 7. The positioning of extension spring 14 is not shown in FIG. 5, but can be seen in FIG. 13. Furthermore, the notches 17 in the top surfaces of lifters 7, the top surfaces of base rails 6, the bottom surfaces of top rails 10, and the bottom surfaces of locking bars 9 all assist in the compact collapsed configuration of table assembly 1, which can have a height dimension less than four-inches.

Figure 7:
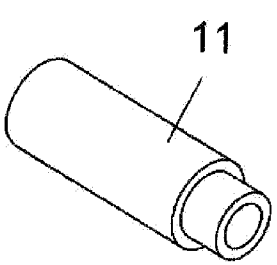
FIG. 7 is a perspective view of the spacer preferred for use as a part of the most preferred embodiment of the present invention
Figure 6:
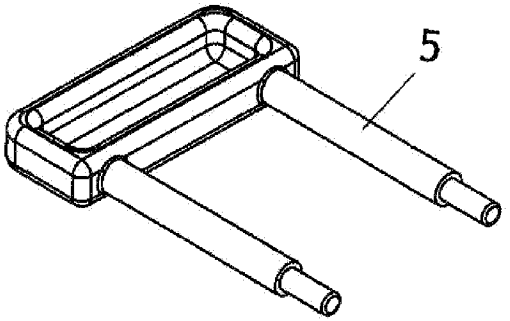
FIG. 6 is a perspective view of the locking/release handle preferred for use as a part of the most preferred embodiment of the present invention
Figure 8:
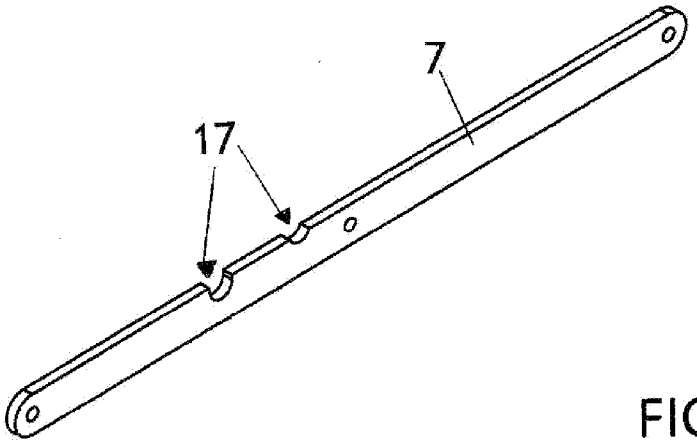
FIG. 8 is a perspective view of the lifter preferred for use as a part of the most preferred embodiment of the present invention
Figure 10:
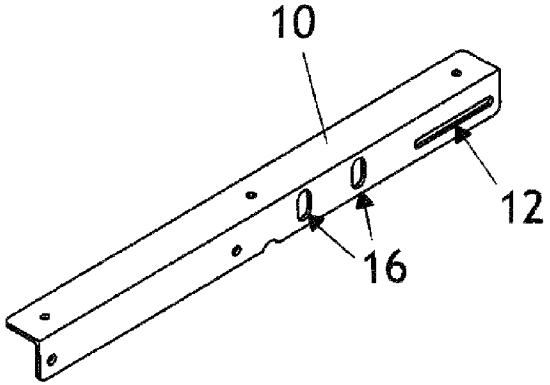
FIG. 10 is a perspective view of the top rail preferred for use as a part of the most preferred embodiment of the present invention
Figure 9:
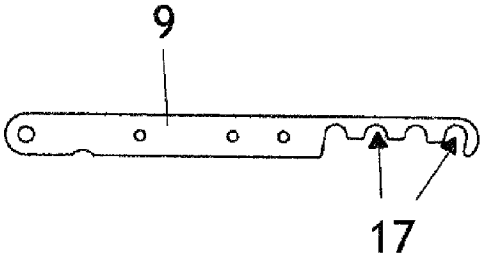
FIG. 9 is a perspective view of the locking bar preferred for use as a part of the most preferred embodiment of the present invention
Figure 11:
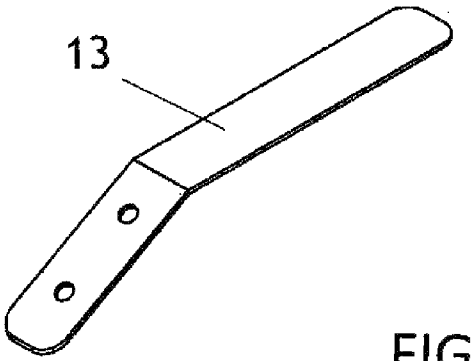
FIG. 11 is a perspective view of the flat spring preferred for use as a part of the most preferred embodiment of the present invention
Figure 13:
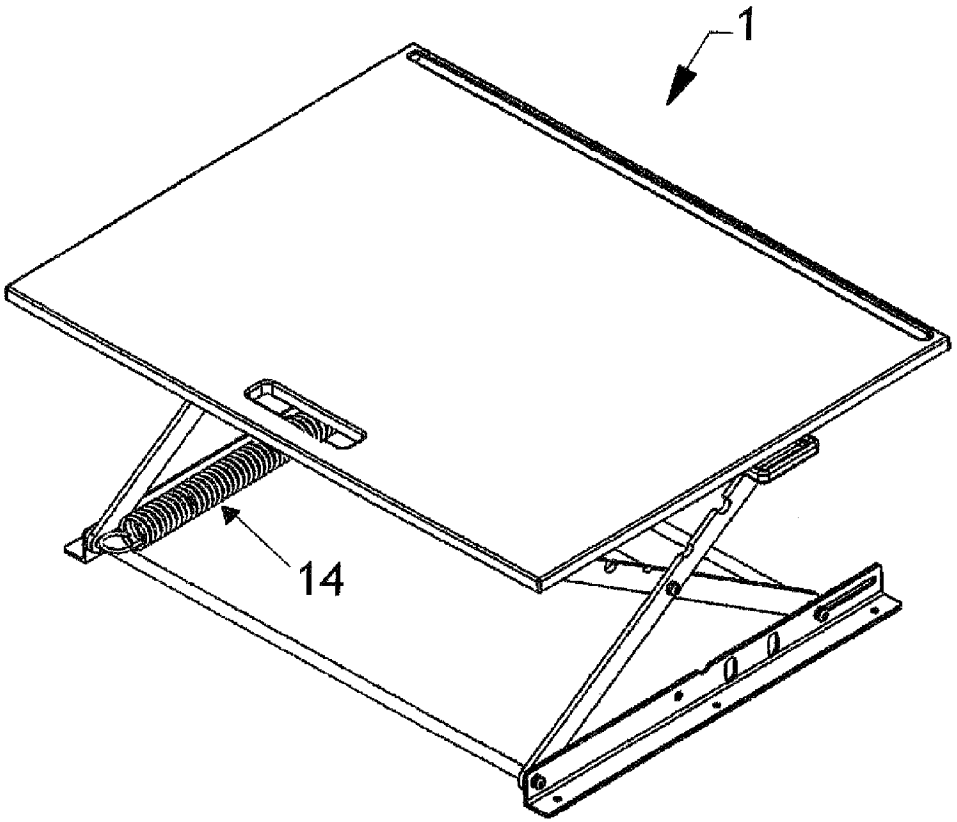
FIG. 13 is a perspective view of the table in the most preferred embodiment of the present invention in an expanded configuration with one of the two extension springs used for spring assist movement of table top shown in its preferred position of use.
Figure 12:
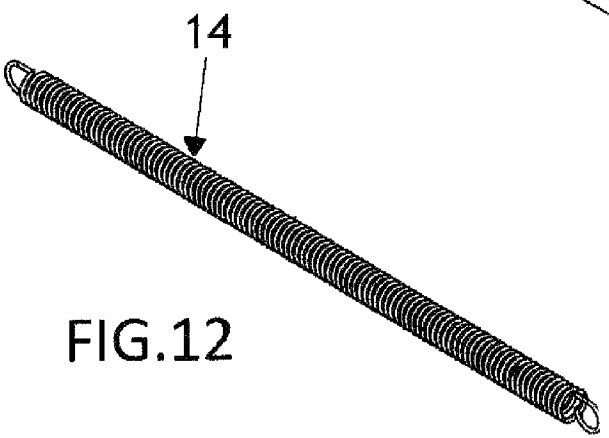
FIG. 12 is a perspective view of the extension spring preferred for use as a part of the most preferred embodiment of the present invention

FIGS. 6-12 show individual components usable as a part of the most preferred embodiment of the present invention, with FIG. 13 showing one of the two extension springs 14 typically used in its preferred position of use. Also, although the configurations of the locking/release handle 5, spacer 11, lifter 7, locking bar 9, extension spring 14, flat spring 13, and the top rail 10 shown in FIGS. 6-12 are preferred, it is contemplated for variation to occur, such as but not limited to thickness dimension, as long as weight considerations are met for easy portability and each can effectively fulfill its intended function. FIG. 6 is a perspective view of the locking/release handle 5 preferred for use as a part of table assembly 1, while FIG. 7 is a perspective view of the spacer 11 preferred for use in the connection of an axis rod 8 to a lifter 7, and either a base rail 6 or a top rail 10. Spacers 11 also can be used to secure the opposed ends of lock rods 15 to different top rails 10. FIG. 8 is a perspective view of lifter 7, while FIG. 9 is a perspective view of the locking bar 9 used for selecting the amount of elevation preferred for table top surface 2 relative to base rails 6. FIG. 10 is a perspective view of a top rail 10 used to secure the top ends of lifters 7 to the underside surface of table top surface 2. A slot 12 is marked in FIG. 10, as are the openings 16 used to secure a locking/release handle 5. FIG. 11 is a perspective view of the flat spring 13 used to bias locking bar 9 in a closed position (refer to FIG. 5), and FIG. 12 is a perspective view of the extension spring 14 used for spring assist while raising and lowering table top surface 2. In addition, FIG. 13 shows extension spring 14 in its desired position of use. Typically, two extension springs 14 are used as a part of the present invention table assembly 1, and are located on opposite sides of table assembly 1 from one another.

To use the present invention on the top surface of a desk or supporting table (not shown), no assembly is required. One simply places the base rails 6 of a collapsed table assembly 1 on the top surface of the desk or supporting table. If the top surface of the desk or supporting table is very smooth, padding (not shown) can be placed between the base rails 6 and the top surface of the desk or supporting table to prevent unintended sliding movement of one or both base rails 6 across the top surface of the desk or supporting table. If the table top surface 2 of table assembly 1 needs to be raised for user comfort or use by a standing person, the two opposed locking/release handles 5 are pulled simultaneously in a slightly outward, but substantially upwardly direction to release the adjacent locking bars 9, as can be determined by the structure visible in FIGS. 3-5. Once the desired elevation for table top surface 2 is achieved, locking/release handles 5 are returned to their original positions. The raising and lowering of table top surface 2 is fast and easy, and may be repeated as often as required to accommodate a user's needs.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, but instead encompassing all embodiments and methods within the scope and spirit of the invention disclosed.

We claim:

1. A portable and elevation-adjustable table top assembly placed on top of a horizontally-extending surface to provide its users with health and comfort advantages, said table top assembly comprising:

a table top surface with a front portion, a rear portion, and opposed sides;

two pairs of lifters centrally and rotatably joined to one another forming an X-shaped configuration, each said lifter having a top end and a bottom end, and each of said pairs of lifters associated with a different one of said opposing sides of said table top surface in positions creating two sets of laterally opposed lifter top ends and two sets of laterally opposed lifter bottom ends;

two top rails each associated with a different one of said opposing sides of said table top surface, each said top rail also connected to a different one of said two sets of laterally opposed lifter top ends, and each said top rail also having an elevation-adjusting slot;

two base rails having spaced-apart positioning under and between said opposed sides of said table top surface, said base rails each having an elevation-adjusting slot, and said base rails each also connected to a different one of said two sets of laterally opposed lifter bottom ends;

five axis rods, two of said axis rods connected between said base rails with one of said axis rods connected between said two elevation-adjusting slots in said base rails, two additional ones of said axis rods connected between said top rails with one of said axis rods connected between said two elevation-adjusting slots in said top rails, and the fifth one of said axis rods connected between said opposed pairs of said lifters where said lifters in each said pair are centrally and rotatably joined forming an X-shaped configuration;

two spaced-apart locking bars associated with said table top surface, each said locking bar positioned adjacent to a different one of said top rails;

two locking rods having spaced-apart positioning between said locking bars; and two locking handles, each positioned near a different one of said opposed sides of said table top surface and engaging a different one of said locking bars, wherein when said locking handles are moved to release said locking bars, said table top surface can be movable vertically to a new elevation between a maximum extended configuration and a minimum collapsed configuration.

2. The table top assembly of claim 1 wherein said table top surface further comprises a carrying handle cutout associated with said tabletop surface.

3. The table top assembly of claim 1 wherein said table top surface further comprising a groove associated with said table top surface.

4. The table top assembly of claim 3 wherein said groove extends substantially across said table top surface, and further comprising a carrying handle cutout adjacent to a perimeter edge remote from said groove.

5. The table top assembly of claim 4 further wherein said carrying handle cutout is positioned remotely from said groove.

6. The table top assembly of claim 1 wherein each of said base rails has an L-shaped configuration.

7. The table top assembly of claim 1 wherein each of said top rails has an L-shaped configuration.

8. The table top assembly of claim 1 wherein said table top surface has a maximum elevation change of approximately one foot.

9. The table top assembly of claim 1 wherein said minimum collapsed configuration is approximately three-and-one-fourth inches.

10. The table top assembly of claim 1 further comprising two extension springs providing assisted lifting of said table top surface during up and down deployment thereof.

11. The table top assembly of claim 1 further comprising a flat spring associated with each said locking bar, securing said locking bar after said table top surface is moved to a new elevation.

12. The table top assembly of claim 1 further comprising spacers associated with said axis rods.

13. The table top assembly of claim 1 further comprising notches assisting the lowering of said table top surface into a compact collapsed configuration, said notches selected from a group consisting of notches in said lifters, notches in said base rails, notches in said top rails, and notches in said locking bars.

14. The table top assembly of claim 13 wherein said notches in said locking bars are each configured to receive one of said axis rods.

15. A portable and elevation-adjustable table top assembly placed on top of a horizontally-extending surface to provide its users with health and comfort advantages, said table top assembly comprising:

a table top surface with a front portion, a rear portion, opposed sides, and a carrying handle cutout centered between said opposed sides;

two pairs of lifters centrally and rotatably joined to one another forming an X-shaped configuration, each said lifter having a top end and a bottom end, and each of said pairs of lifters associated with a different one of said opposing sides of said table top surface in positions creating two sets of laterally opposed lifter top ends and two sets of laterally opposed lifter bottom ends;

two top rails each associated with a different one of said opposing sides of said table top surface, each said top rail also connected to a different one of said two sets of laterally opposed lifter top ends, and each said top rail also having an elevation-adjusting slot and two spaced-apart openings therethrough near said elevation-adjusting slot;

two base rails having spaced-apart positioning under and between said opposed sides of said table top surface, said base rails each having an elevation-adjusting slot, and said base rails each also connected to a different one of said two sets of laterally opposed lifter bottom ends;

five axis rods, two of said axis rods connected between said base rails with one of said axis rods connected between said two elevation-adjusting slots in said base rails, two additional ones of said axis rods connected between said top rails with one of said axis rods connected between said two elevation-adjusting slots in said top rails, and the fifth one of said axis rods connected between said opposed pairs of said lifters where said lifters in each said pair are centrally and rotatably joined forming an X-shaped configuration;

two spaced-apart locking bars associated with said table top surface, each said locking bar positioned adjacent to a different one of said top rails;

two locking rods having spaced-apart positioning between said locking bars; and two locking handles, each positioned near a different one of said opposed sides of said table top surface and engaging a different one of said locking bars, said two locking handles also extending in part through said two spaced-apart openings, wherein when said locking handles are moved to release said locking bars, said table top surface can be movable vertically to a new elevation between a maximum extended configuration and a minimum collapsed configuration.

16. The table top assembly of claim 15 wherein said minimum collapsed configuration is approximately three-and-one-fourth inches.

17. The table top assembly of claim 15 made from materials selected from lightweight materials, plastics, recycled plastics, and metal.

18. A method of raising and lowering said table top surface in claim 15 comprising the steps of:

providing said table top assembly of claim 15 and a horizontally-extending surface;

placing said base rails on said horizontally-extending surface;

applying a slightly outward but substantially upward pulling force simultaneously to each said locking handle until engagement of said locking handle with said locking bars is released;

adjusting said table top surface to a new desired elevation; and returning said locking handles to their original positions in locking engagement with said locking bars.

* * * * *